US010532260B2

(12) United States Patent
Del Monte

(10) Patent No.: US 10,532,260 B2
(45) Date of Patent: Jan. 14, 2020

(54) SPORTS TRAINING APPARATUS

(71) Applicant: Dion Del Monte, Mississauga (CA)

(72) Inventor: Dion Del Monte, Mississauga (CA)

( * ) Notice: Subject to any disclaimer, the term of this patent is extended or adjusted under 35 U.S.C. 154(b) by 0 days.

(21) Appl. No.: 15/622,511

(22) Filed: Jun. 14, 2017

(65) Prior Publication Data

US 2017/0361190 A1 Dec. 21, 2017

Related U.S. Application Data

(60) Provisional application No. 62/352,258, filed on Jun. 20, 2016.

(51) Int. Cl.

| | |
|---|---|
| ***A63B 69/00*** | (2006.01) |
| *A63B 5/02* | (2006.01) |
| *A63B 102/24* | (2015.01) |
| *E01F 13/02* | (2006.01) |
| *A63B 71/00* | (2006.01) |

(52) U.S. Cl.

CPC ..... *A63B 69/0026* (2013.01); *A63B 69/00* (2013.01); *A63B 71/0036* (2013.01); *A63B 2102/24* (2015.10); *A63B 2210/00* (2013.01); *E01F 13/02* (2013.01); *E01F 13/028* (2013.01)

(58) Field of Classification Search

CPC ..... A63B 69/0026; A63B 2102/24; A63B 2210/00

USPC ..... 473/446, 422, 478; 116/63 P, 63 R, 116/63 C; 482/16; 40/612

See application file for complete search history.

(56) References Cited

U.S. PATENT DOCUMENTS 2,333,273 A * 11/1943 Scanlon ..... E01F 9/612 116/200
3,496,904 A * 2/1970 Rimkus ..... E01F 9/688 116/63 C
3,709,489 A * 1/1973 Holleran ..... A63B 69/00 473/446
3,860,209 A * 1/1975 Strecker ..... B60P 7/13 24/265 CD
4,125,339 A * 11/1978 Pittinger, Sr. ..... A01D 34/416 403/348
4,400,856 A * 8/1983 Tseng ..... B60P 7/13 24/109
5,030,029 A * 7/1991 Johnsen ..... E01F 13/02 116/202
5,036,791 A * 8/1991 Thurston ..... E01F 9/692 116/63 C
5,669,833 A * 9/1997 Stone ..... A63B 69/002 473/422

(Continued)

*Primary Examiner* — Mitra Aryanpour
(74) *Attorney, Agent, or Firm* — Kagan Binder PLLC

(57) ABSTRACT

An apparatus for training athletes having two supporting structures. The first structure has a base that can rest on a surface and walls that extend upward from the base to an upper end, defining an interior space. The walls incorporate a bar connector above the base designed to connect to and support one end of a bar. The walls have supporting elements above the base and below the upper end of the walls. The second structure has walls that are configured so that the lower end of the walls can engage the supporting elements of the first structure so that the second structure is supported by the first structure above the supporting elements. The second structure has a bar connector at the same height as the height of the bar connector of the first structure configured to connect to and support the other end of the bar.

20 Claims, 6 Drawing Sheets

(56) References Cited

U.S. PATENT DOCUMENTS 6,165,084 A 12/2000 Cranston
6,182,600 B1 * 2/2001 Brown ..... E01F 9/688 116/63 C
6,237,895 B1 * 5/2001 Thurston ..... E01F 13/022 116/63 P
6,851,660 B1 * 2/2005 Cravatt ..... E04H 17/168 256/19
6,971,329 B1 * 12/2005 Stewart ..... E01F 13/028 116/63 C
8,714,307 B2 * 5/2014 Burnett ..... B25H 1/04 182/151
8,777,512 B2 * 7/2014 Henderson ..... E01F 13/02 116/63 C
8,823,549 B1 * 9/2014 Moone ..... G08G 1/01 116/63 C
9,109,374 B1 * 8/2015 Blocker ..... E04G 21/3233 256/19
9,797,102 B2 * 10/2017 Maus ..... E01F 9/654 116/63 P
9,863,578 B2 * 1/2018 Cuttill ..... F16M 13/022 116/63 C
2003/0096666 A1 * 5/2003 Zielinski ..... A63B 69/0024 473/446
2004/0060499 A1 * 4/2004 Penque, Jr. ..... E01F 13/028 116/63 P
2004/0159280 A1 * 8/2004 Mohelsky ..... A63C 19/062 116/63 C
2006/0063615 A1 * 3/2006 Richardson ..... A63B 63/007 473/446
2006/0266274 A1 * 11/2006 Kuo ..... E01F 13/02 116/63 P
2008/0032827 A1 * 2/2008 Behrend ..... A63B 69/002 473/446
2008/0248902 A1 10/2008 Pittorf
2008/0287224 A1 * 11/2008 Salvador ..... A63B 69/0024 473/446
2012/0083367 A1 4/2012 Quinn
2012/0178553 A1 * 7/2012 Laird ..... A63B 69/002 473/446
2012/0196725 A1 * 8/2012 Burrell ..... A63B 5/22 482/16
2016/0158616 A1 * 6/2016 Lancaster ..... A63B 69/00 473/422
2017/0361190 A1 * 12/2017 Del Monte ..... A63B 69/0026 473/446

* cited by examiner

SPORTS TRAINING APPARATUS

PRIORITY CLAIM

This application claims priority to United States Provisional Patent Application having Ser. No. 62/352,258, filed on Jun. 20, 2016, which application is hereby incorporated by reference in its entirety.

FIELD OF THE INVENTION

The present invention relates generally to equipment for training athletes, and more particularly to equipment including supporting structures with a horizontal bar connecting them for maneuvering around while passing a ball or puck under the bar.

BACKGROUND OF THE INVENTION

A variety of training apparatus are available around and through which athletes may maneuver themselves and/or a puck or ball for the purpose of improving agility and/or puck control. These apparatuses usually consist in general terms of a bar or stick supported above the ground by two or more supporting structures creating an area under the bar through which the puck or ball can be moved. For ease of construction and to reduce costs, many of these devices employ identical supporting structures, which if narrow are prone to tipping over and which if wide limit access to the space under the bar, thereby limiting the effectiveness of the training tool.

Typically, coaches or instructors will purchase and bring 8-20 typical plastic cones with them to each practice to mark off drills for players to execute. Such cones are not difficult for hockey players to stickhandle around and offer little challenge to skilled players. Some coaches may bring additional training apparatuses to use as obstacles to move around and pass the puck through. These training apparatuses are often heavy or bulky to transport to the arena or require significant time to construct or break down before and after training. Often these training apparatuses are appropriate only for a very limited number of training uses.

There is a need in the art for a training apparatus that is lightweight, stackable for portability, easy to deploy, functions on a variety of surfaces, resists tipping over and sliding when bumped during use and which can be formed into a variety of configurations to challenge athletes of all levels.

SUMMARY OF THE INVENTION

The invention provides a training apparatus for training athletes. In preferred embodiments, the apparatus includes first and second supporting structures and a bar. The first supporting structure has a base that can rest on a surface, such as the ice surface of a hockey rink. Walls extend upward from the base to an upper end to define an interior space. The walls of the first supporting structure include a first bar connector that is above the base. The first bar connector is designed to connect to one end of the bar and support the end of the bar. The walls have a number of supporting elements above the base.

The second supporting structure has walls that define an interior space. The walls have a lower end and are configured so that the lower end of the walls can engage the supporting elements of the first supporting structure so that the second supporting structure is supported by the first supporting structure above the supporting elements. The second supporting structure has a first bar connector at a height above the lower end of the walls of the second supporting structure substantially the same as the height of the first bar connector above the base of the first supporting structure. The first bar connector of the second supporting structure is configured to connect to and support the other end of the bar.

When the lower end of the walls of the second supporting structure is engaged with the supporting elements so that the second supporting structure is supported by the first supporting structure above the supporting elements, an upper portion of the walls of the first supporting structure preferably extends into the interior space of the second supporting structure. The first and second supporting structures may include locking mechanisms to releasably lock the structures together when the lower end of the walls of the second supporting structure is engaged with the supporting elements of the first supporting structure, and the locking mechanisms may be the configuration of the structures so that the outer surface of the upper portion of the walls of the first supporting structure that extends into the interior space of the second supporting structure frictionally engages the inner surface of a portion of the walls of the second supporting structure.

The support elements preferably are a ledge extending around the walls of the first supporting structure below the upper end of the walls. The ledge may extend laterally from an outer portion of the walls of the first supporting structure towards the interior space of the first supporting structure, and the ledge and the second supporting structure may be configured so that when the lower end of the second supporting structure engages the ledge so that the second supporting structure is supported by the ledge, a lower outer portion of the outer surface of the second supporting structure and a portion of the outer surface of the walls of the first supporting structure provide a continuous outer wall of a combined structure consisting of the two supporting structures. The different portions of the ledge may be at differing heights above the base and the lower end of the walls of the second supporting structure may be configured to engage with all the portions of the ledge.

The first and second supporting structures preferably include locking mechanisms to releasably lock the structures together when the lower end of the walls of the second supporting structure is engaged with the supporting elements of the first supporting structure. The locking mechanisms may include protrusions on an inner surface of a lower portion of the second supporting structure and locking openings on an outer surface of the first supporting structure positioned above the supporting elements and configured to engage the projections.

The walls of the first supporting structure are preferably tapered inwardly from the base towards the upper end, and the walls of the second supporting structure are preferably tapered inwardly from the lower end upwards. The first supporting structure may have a lower opening and when the lower end of the walls of the second supporting structure is engaged with the supporting elements so that the second supporting structure is supported by the first supporting structure above the supporting elements, the first training apparatus is stackable with a second training apparatus, when the lower end of the walls of the second supporting structure of the second training apparatus is engaged with the supporting elements of the second training apparatus so that the second supporting structure of the second training apparatus is supported by the first supporting structure of the second training apparatus above the supporting elements, by inserting the second supporting structure of the second training apparatus into the lower opening of the first supporting structure of the first training apparatus and pushing the first training apparatus downward.

The first bar connector of the first supporting structure may include a bar opening in the walls of the first supporting structure sized to receive the first end of the bar, where the bar is connectable to the first bar connector by the first end of the bar extending through the bar opening into the interior space of the first supporting structure. Furthermore, the first bar connector of the second supporting structure may include a bar opening in the walls of the second supporting structure sized to receive the second end of the bar, so that the bar can be connected to the first bar connector of the second supporting structure by the second end of the bar extending through the bar opening into the interior space of the second supporting structure.

The bar connectors are preferably configured and located so that when the base of the first supporting structure and the lower end of the walls of the second supporting structure are both resting on the same surface, the bar and the first and second supporting structures can be arranged so that the bar is connected to the bar connector in both supporting structures at the same time so that the bar is substantially parallel to the surface and the bar is spaced apart from the surface by more than one inch.

The walls of the first and second supporting structures may be frusto-conical.

The first supporting structure may have no top portion covering the interior space.

The walls of the first supporting structure may have a second bar connector configured to connect to and support the first end of the bar.

The second supporting structure may have a second bar connector, so that the bar can be placed so that the first end of the bar connects to the first bar connector of the second supporting structure while another bar connects to the second bar connector of the second supporting structure.

The base of the first supporting structure is preferably configured to resist sliding when the first supporting structured rests on ice. The base of the first supporting structure may be made of a material that resists sliding on an ice surface.

The lower end of the walls of the second supporting structure may be configured to resist sliding when the second supporting structured rests on an ice surface.

The walls of the first and second supporting structures may each define a hollow pyramidal structure.

The invention also provides a training apparatus for training athletes including a base cone and a nose cone. The nose cone and base cone are configured to allow the nose cone to nest on top of the base cone to create a combined cone. The base cone and nose cone each have a bar connector configured to connect to and support an end of a bar. The bar connectors are configured and located to support the bar substantially parallel to and spaced apart from a surface when the nose cone and the base cone are each resting directly on the surface. The base cone may be frusto-conical and have an open upper end.

The base cone may have a lower opening and an open top end to facilitate stacking of pairs of nested cones. When the cones of the first training apparatus are nested, the first training apparatus is stackable with a second training apparatus when the cones of the second training apparatus are nested by inserting the nose cone of the second training apparatus into the lower opening of the base cone of the first training apparatus and pushing the first training apparatus downward. The base cone may include projections extending outwardly from the walls of the base cone spaced apart from the lower end of the base cone and configured to limit the downward movement of the first training apparatus by abutting the lower end of the base cone of the first training apparatus when the nose cone of the second training apparatus is inserted into the lower opening of the base cone of the first training apparatus and the first training apparatus is pushed down on the second training apparatus.

The nose cone preferably has a circular lower opening sized and shaped to receive and frictionally engage a hockey puck.

In other embodiments, the invention provides a training apparatus for training athletes including a hollow base cone and a hollow nose cone. The nose cone and base cone are configured to allow the nose cone to releasably lock atop the base cone to form a single larger cone that is stackable for storage. The base cone and nose cone each have a mechanism for releasably connecting to opposite ends of an expandable, elongated cross member such that the cross member is supported above a flat surface upon which the base cone and nose cone rest. The cross member is supported by the cones so that it is substantially parallel to the flat surface.

DETAILED DESCRIPTION OF THE INVENTION

The invention is an apparatus for training athletes, such as hockey players. A preferred embodiment is shown in FIGS. 1-5. The apparatus has a first supporting structure and a second supporting structure. The first supporting structure shown in the figures is a base cone 100, and the second supporting structure shown in the figures is a nose cone 101. In general, the first supporting structure has a base 103 and walls extending upwardly from the base to an upper end, preferably inwardly tapered. The walls define an interior space (i.e. the structure is hollow).

Figure 1:
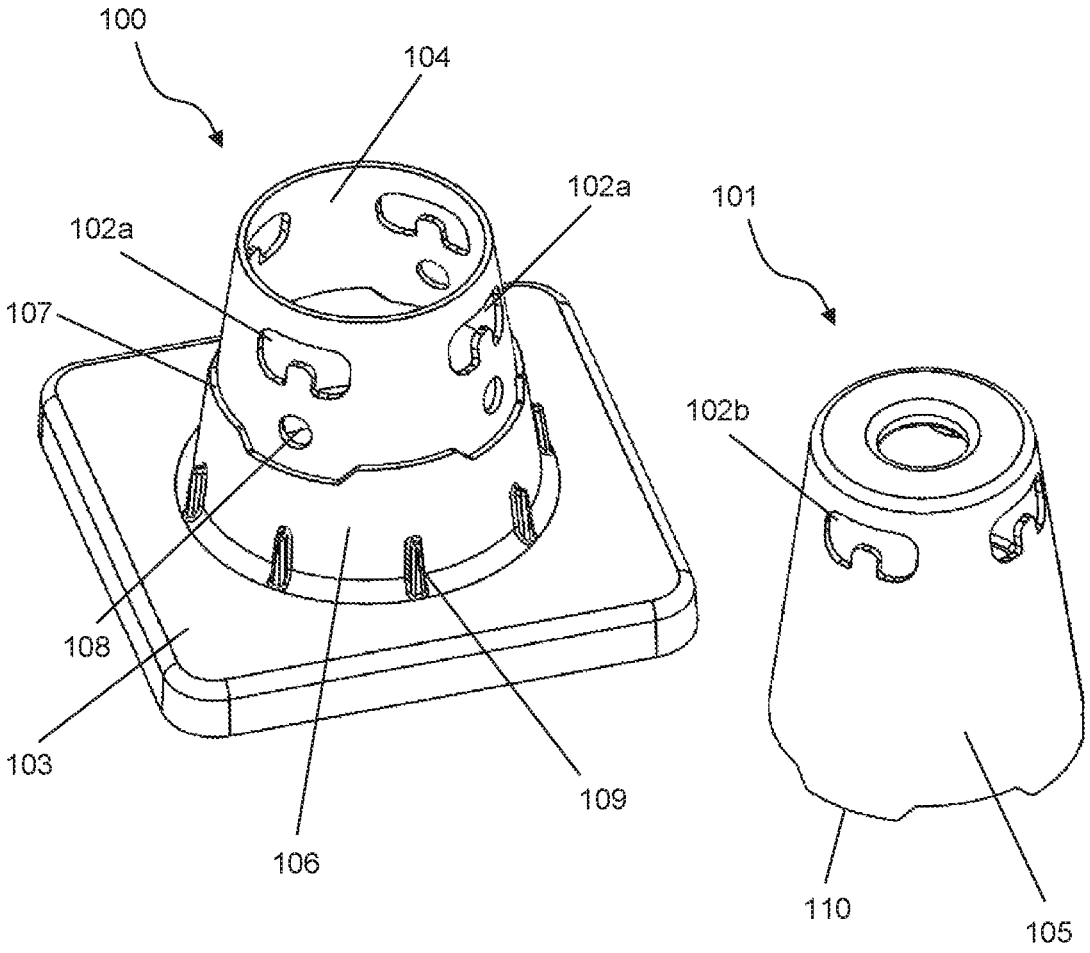
FIG. 1 is a perspective view of an embodiment of the training apparatus showing the base cone and nose cone when they have been separated and are both resting on a flat surface with openings in the walls of the cones visible.
Figure 2:
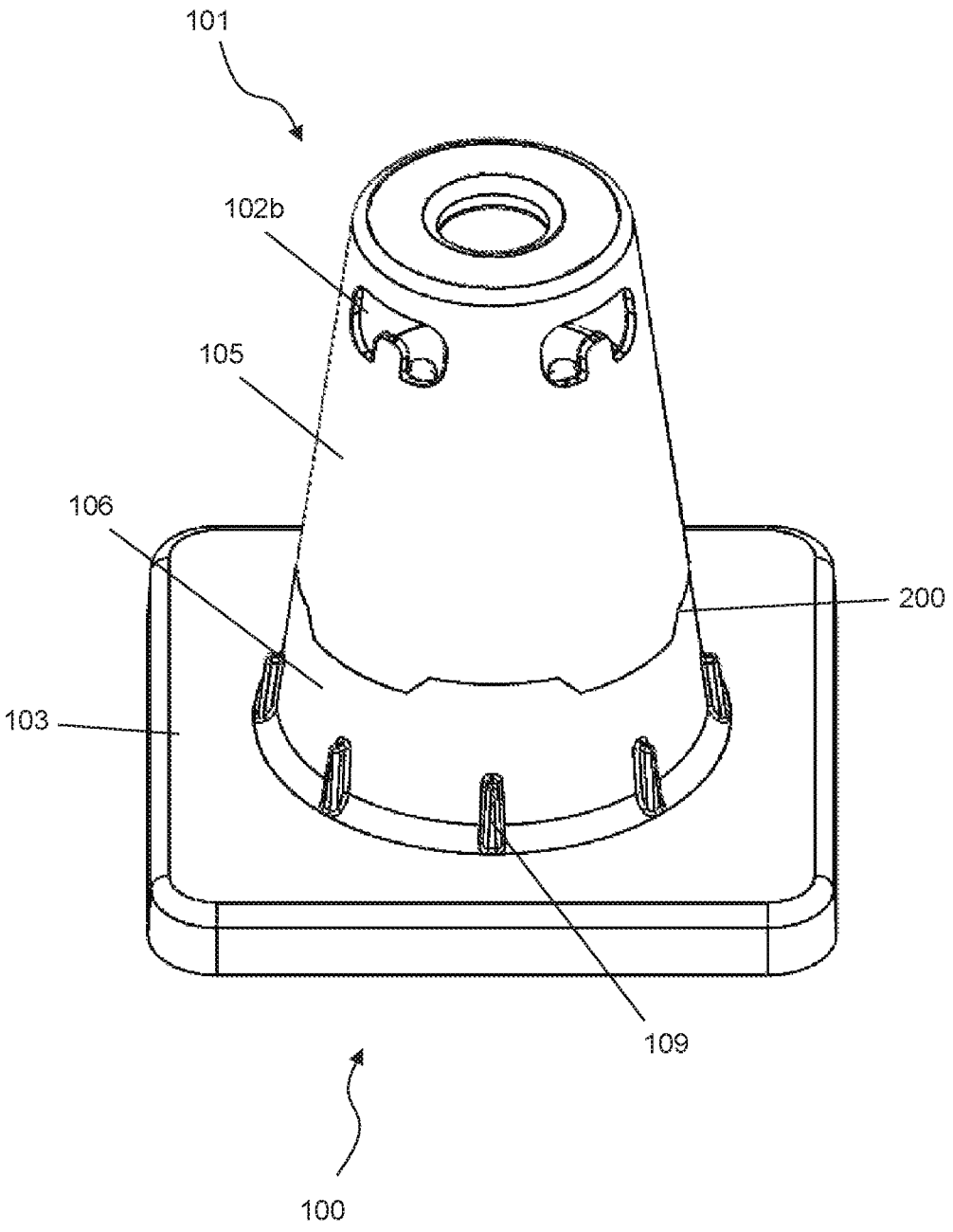
FIG. 2 is a perspective view of the nose cone nested on and locked to the base cone.

"Walls" are referred to herein in the plural, although there may be one continuous frusto-conical wall, such as walls 104 and 106 of the base cone 100. In other embodiments, there may be multiple wall segments at angles to each other, such as in a pyramidal arrangement. The walls are preferably symmetric in that any horizontal cross-section through the walls is a circle or a regular polygon, although irregular cross-sections such as rectangular are not excluded. In general, any design where opposing walls are the same distance from a central vertical axis are preferred. The term "tapered" as used herein means that, for any vertical line along the walls from the lower end or bottom to the top, the distance of the line from the central axis does not increase at any point going from bottom to top, and decreases at one or more points, or decreases continuously as in the case of a true cone. In particular, a stepped tapering may be employed with multiple portions of such a described vertical line being perpendicular to the vertical axis. Non-tapered embodiments, such as where the walls form a cylinder are possible but not preferred, in particular because they are not stackable so that multiple pairs of nested cones can be stacked together. As used herein, "nested cones" means one nose cone nested on top of a base cone to form a "combined cone" such as shown in FIG. 2.

The nose cone and base cone are preferably configured so that the tops of the cones are approximately the same height above a surface when the cones are separated and are each resting on the surface. It is preferable, for example in the context of hockey, that they are of similar height so that the clearance required for a player's hockey stick to pass over each cone is about the same.

The structures may be made from any suitable material, such as plastic or rubber.

In the embodiment shown in the figures, the base cone 100 has four openings 102*a* that are bar connectors configured to receive and support one end of a bar 400. A bar 400 is generally a straight elongated member, which may also be referred to as a stick. Generally, the bar 400 has a constant cross-section orthogonal to its length, although this is not required. The bar is preferably extendable so that it can be configured to have various lengths. The bar may be formed by any suitable material such as wood, plastic, metal or composite materials.

In general, the second supporting structure has a lower end, being the lower end 110 of its walls 105, and the walls extend upwardly from the lower end, preferably inwardly tapered.

As shown in the figures, the nose cone 101 also has four openings 102*b* that are bar connectors configured to receive and support one end of the bar 400. The bar connectors 102*a*, 102*b* are all the same size. In general, each cone has one or more such bar connectors, but preferably at least two. It is not essential that the bar connectors all be of the same configuration or size, but it is preferred that they are of the same configuration and size. In some embodiments, the bar connectors are not openings. For example, a protrusion from the walls configured to support an end of the bar, possibly with some mechanism to releasably lock to an end of the bar, such as Velcro®, could be used as a bar connector. The bar may need to be specially adapted to connect to particular types of bar connectors, for example by having Velcro® at the ends. Where the bar connectors are openings 102*a*, 102*b*, no special adaptation of the ends of the bar is required, which is preferred. A bar connector including an opening may further include a flexible "tongue" mechanism designed to engage and apply pressure to an upper or lower surface of the bar when inserted in the opening. Such a bar connector with a flexible "tongue" mechanism could also be used to interact with a bar specially constructed with a recess or hole at each end into which the tongue would fit to prevent the stick from unintentionally sliding out of the opening in the nose or base cone The base cone has a ledge 107 extending around its walls above a lower portion of the walls 106 and below an upper portion of the walls 104. In the depicted embodiment, the ledge has portions at varying heights about the base. It should be noted that such references to height above the base herein should be understood to refer to the height above the bottom of the base, which is the same as the height of a surface on which the base is resting. The ledge extends laterally from the outer surface of the top of the lower portion of the walls 106, towards the central vertical axis in the interior space of the base cone, to the lower end of the upper portion of the walls 104. Both the lower and upper portions of the walls are inwardly tapered at about the same angle. The lateral width of the ledge is approximately equal to the thickness of the walls of the nose cone. The lower end 110 of the nose cone 101 is configured to be complementary in configuration to the ledge 107 so that the heights and radial extents of portions of the lower end 110 vary in correspondence with the variation of the heights and radial extents of the portions of the ledge so that the nose cone 101 may be placed on top of the base cone 100 with the lower end 110 of the walls of the nose cone 101 in full contact with the ledge 107 so that the base cone 100 supports the nose cone 101 as shown in FIG. 2. The mating of the cones via a variable height abutment prevents rotation of the nose cone 101 relative to the base cone 100 when the nose cone 101 is nested on the base cone 100, and limits the radial orientation of the nose cone 100 when engaged with the base cone 100. Such a limitation may be very useful in configurations using locking mechanisms employing elements on each cone that need to be radially aligned, such as the protrusion/locking opening mechanism discussed below.

When the nose cone is nested on the base cone as shown in FIG. 2, the configuration of the base and nose cones causes the outer surface of the nose cone 105 and the lower portion of the walls of the base cone 106 to form a smooth and continuous outer surface of a combined cone formed by the two nested cones, although a line and small discontinuities may be visible at the portion 200 of the outer surface where the lower end 110 of the nose cone 101 abuts and is supported by the ledge 107 of the base cone 100.

The term "cone" as used herein is intended to include frustocones, such as the depicted shapes of the base cone 100, the nose cone 101, and the combined cone formed when the nose cone is nested on the base cone 100 as depicted in FIG. 2. It also includes structures where the tapering of the walls is not continuous but occurs in steps, for example. In some embodiments, of course, the walls form a true cone with continuously tapered walls.

When the cones are nested, an upper portion of the walls 104 of the base cone 100 extends into the interior space of the nose cone 101. The cones may be similarly tapered and sized so that the outer surface of the upper portion of the walls 104 of the base cone 100 frictionally engages an inner portion of the walls 105 of the nose cone 101 to help keep the cones nested if nested cones are subjected to external forces. In addition to such frictional engagement, the depicted embodiments employ additional releasable locking mechanisms to better lock the cones together when they are nested.

It should be noted that the term "nesting" as used herein does not require that an upper portion of the walls of the first supporting structure extends into the interior space of the second supporting structure. For example, although such embodiments are not preferred, a nose cone may be sized so that the lower end of the nose cone rests on the upper end of a frustoconical base cone (the upper end being a ledge), optionally using a mechanism, such as magnetic material, to maintain the cones in a nested configuration.

Each depicted base cone 100 has a number of slots or locking openings 108 in the upper portion of the wall 104 of the base cone 100. As can be seen in the view of the cones upside-down in FIG. 3, the inner surface of the walls of the nose cone 101 have corresponding protrusions or nubs 300. The locking openings 108 and protrusions 300 are arranged and configured so that when the nose cone 101 is pushed down over the base cone 100 to nest on the base cone 100 with the protrusions 300 and locking openings 108 aligned, the protrusions 300 engage the locking openings 104 to provide a releasable lock. The locking mechanism is configured so that the cones can be separated by applying force pulling the cones apart from each other. In embodiments employing four protrusions 300, each radially spaced by 90 degrees from two other protrusions 300, and four locking openings 108, each radially spaced by 90 degrees from two other locking openings 108, there are four radial orientations in which pushing the nose cone 101 down on the base cone 100 causes the protrusions 300 to engage and lock with the locking openings 108. In such embodiments, it is preferred that the ledge 107 and lower end of the nose cone 101 be configured to align correctly in all and only those four radial orientations, which is the case for the depicted embodiment. More generally, where the locking mechanism requires a discrete set of possible radial orientations of the supporting structures, it is preferred that the supporting elements be configured to correctly engage the lower end of the second supporting structure only in those orientations.

In other embodiments, rather than having protrusions on the inner surface of the walls of the nose cone and locking openings in the walls of the base cone, the locking mechanism may employ protrusions on walls of the base cone and locking openings in the walls of the nose cone.

As will be apparent to skilled persons, various other kinds of releaseable locking mechanisms could be employed. A friction fit of the upper portion of the walls 104 of the base cone 100 with an inner portion of the walls 105 of the nose cone 101 provides a form of locking mechanisms in the configuration of the cones to achieve this friction lock.

Figure 4:
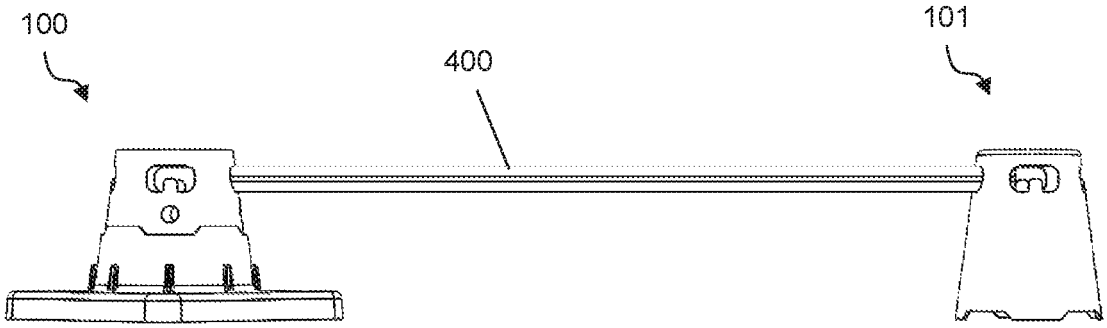
FIG. 4 is a side view of the base cone and nose cone of FIG. 1 when they have been separated and are both resting on a flat surface with a bar extending into an opening in each cone and connecting the cones.

The cones are configured so that the height of the bar openings 102*a* of the base cone 100 above the base 103 or supporting surface are approximately equal to the height of the bar openings 102*b* of the nose cone above the lower edge 110 of the nose cone 101 (meaning the height above the lowest portions of the lower edge, which is equal to the height above a surface when the nose cone 101 is resting directly on the surface). As a result, when a bar 400 is placed with one end of the bar 400 connected to the base cone 100 by placing the end of the bar 400 in a bar opening 102*a* of the base cone 100, and with the other end of the bar 400 connected to the nose cone 101 by placing that end of the bar 400 in a bar opening 102*b* of the nose cone 101, as shown in FIG. 4, then the bar 400 is substantially parallel to the flat surface on which the cones are resting. The bar 400 is spaced apart from the surface by at least enough distance to allow a projectile to pass under it. For use in training hockey players, a spacing of more than one inch is required to allow a hockey puck to pass underneath the bar 400.

Figure 5:
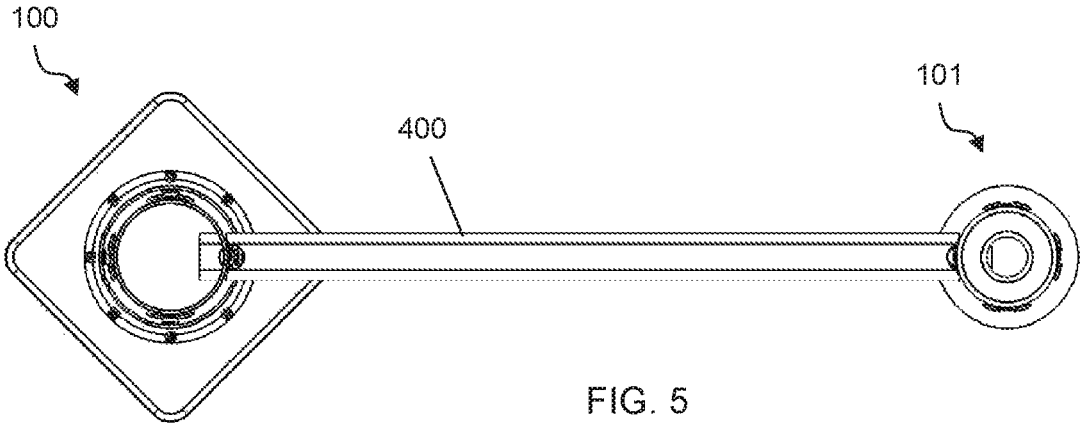
FIG. 5 is a top view of the base cone and nose cone of FIG. 1 when they have been separated and are both resting on a flat surface with a bar extending into an opening in each cone and connecting the cones.

FIG. 5 is a top view of FIG. 4 where one end of the bar 400 can be seen to be inside the interior space of the base cone 100.

Figure 6:
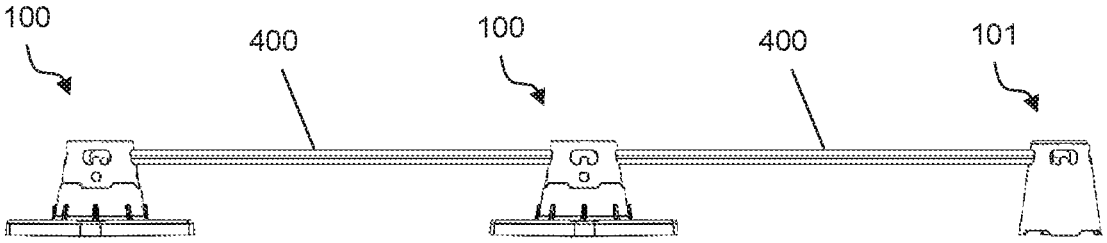
FIG. 6 is a side view of the base cone and nose cone of FIG. 1 when they have been separated and are both resting on a flat surface with a bar extending into an opening in each cone and connecting the cones, along with a second base cone that is also resting on the flat surface with a second bar extending into openings in both the first base cone and the second base cone thereby connecting the cones.
Figure 8:
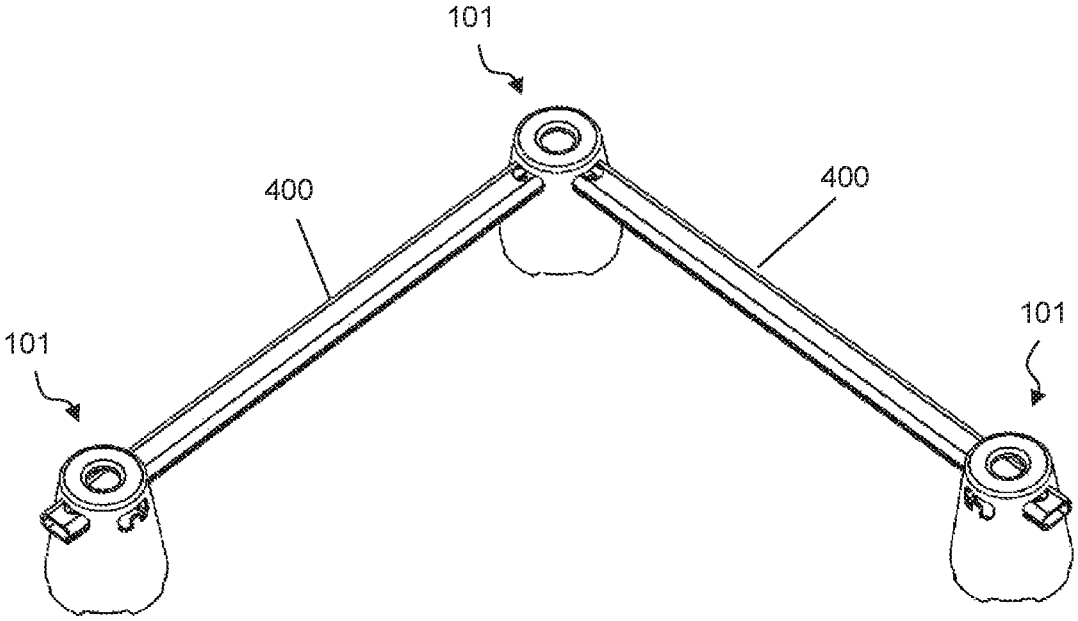
FIG. 8 shows three nose cones resting on a surface connected together by two bars.

In a training session it is quite usual to have many instances of a training apparatus present. The invention is designed so that multiple nose cones 101 and/or multiple base cones 100 can be used in conjunction with multiple bars 400 to form many configurations useful for training purposes. The nose cones and base cones preferably have at least 2-4 bar connectors in order to permit more than two cones to be connected by two or more bars. When openings 102*a*, 102*b* are used as the bar connectors, it is preferred that they include opposing pairs of openings radially separated from each other by 180 degrees. When four openings are included, it is preferred that they be spaced apart radially by about 90 degrees, as shown in the figures. For example, FIG. 6 shows a central base cone 100 connected to a nose cone 101 to the right by one bar 400, and connected to a second base cone 100 on the left by a second bar. Both bars are parallel to the surface that the cones are resting on, and the bars are at the same height above the surface. Another example configuration is shown in FIG. 8 where three nose cones 101 are connected by two bars 400. Since the openings 102*b* are at the same height and pairs of openings 102*b* oppose each other, it is possible to extend an end of the bar 400 through a first opening 102*b*, through the interior space of the nose cone 101, and then through the opposing opening 102*b* on the other side of the nose cone 101 so that the end of the bar 400 extends out from the opposing opening 102*b*, as shown for the two nose cones 101 at the bottom of FIG. 8. Such an approach provides greater stability.

Figure 3:
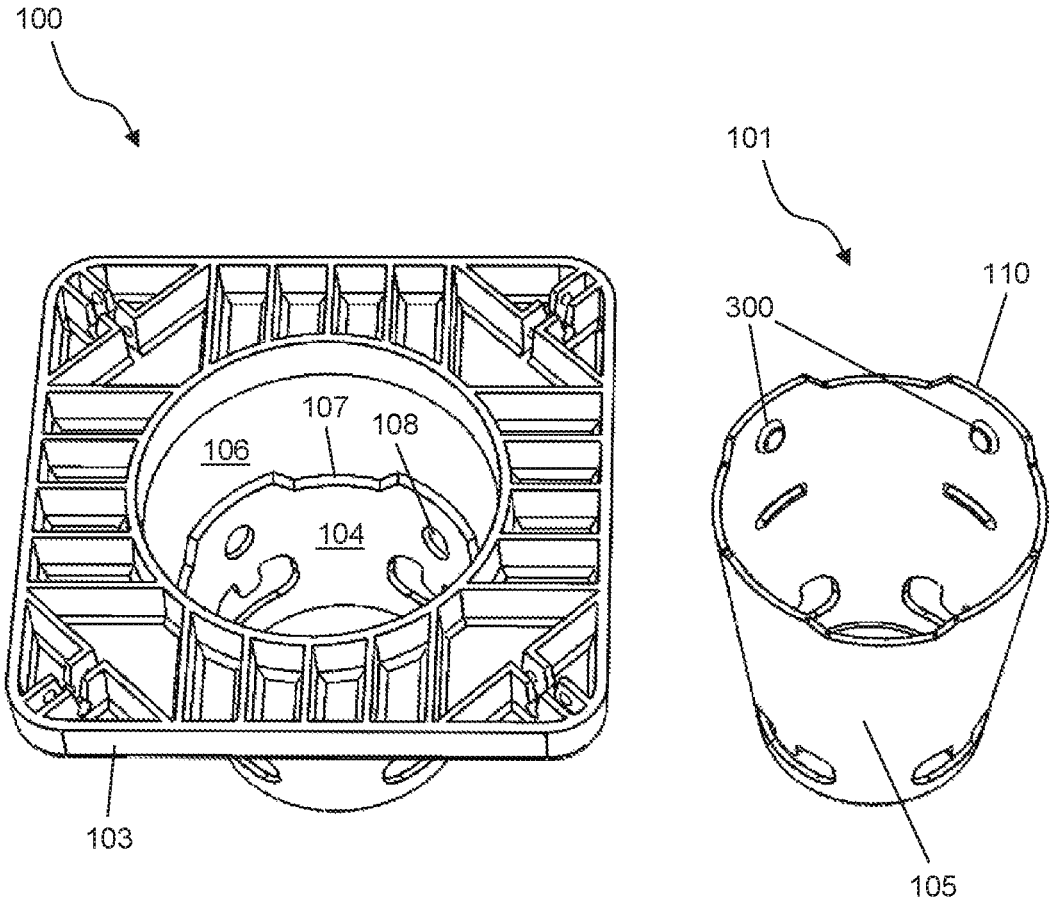
FIG. 3 is a perspective view of the base cone and nose cone of FIG. 1 upside down when they have been separated, showing the lower openings of the cones.
Figure 7:
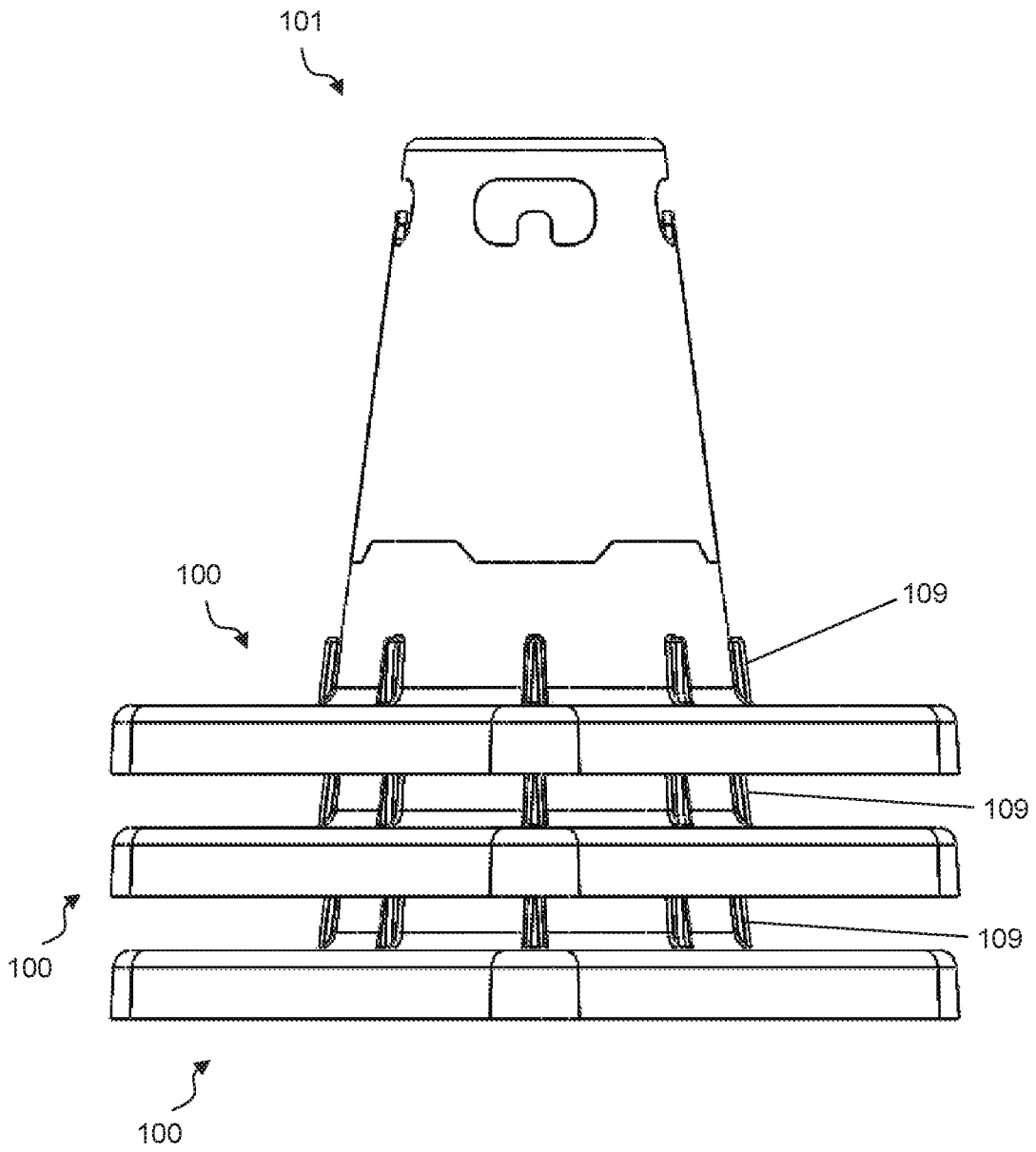
FIG. 7 is a side view showing three pairs of nested base cones and nose cones (three "combined cones") that have been stacked.

As shown in FIG. 3, the base cones 100 also have a lower opening into the interior region defined by the lower end of the walls 104 of the base cone 100. In combination with having no top portion covering the interior space, this allows pairs of nested cones to be stacked together, for example as depicted in FIG. 7. The nose cone of a lower pair of nested cones is inserted into the lower opening in the base cone of an upper pair of nested cones, and the upper pair of nested cones can then be pushed down to stack the pairs of cones. An issue with such stacking is that if the upper cones are pushed far down under large force on the lower cones, it can be very difficult to separate them. To address this problem, the base cone 100 has a number of "risers" 109 that extend outward from the outer surface 106 of the base cone up to a certain height that limits how tightly the nested cone pairs can be stacked. As shown in FIG. 7, the bases of stacked cone pairs are constrained when they are stacked so that they must be separated by at least the height of the risers 109. Any suitable projections outward from the outer wall of the base cone 100 at a suitable height above the top of the base could be used for this purpose.

In the depicted embodiment, a ledge 107 formed in the walls of the base cone 100 is used as supporting elements to abut and support the lower end 110 of the nose cone 101 when cones are nested. Supporting "elements" is used in the plural as each portion of the ledge may be considered to be a supporting element, although the elements are fully connected in the case of a ledge, possibly with height variations as in the depicted embodiment. While a continuous ledge extending around the walls of the base cone 100 is a preferred embodiment, other supporting elements may alternately be used, where such supporting elements may not be connected directly to each other. For example, a number of unconnected ledges could be used, such as four smaller ledges, each extending less than 90 degrees radially, and regularly radially spaced. Simple discrete protrusions can also be used. Various other approaches will be evident to skilled persons.

The present invention is particularly well suited for training hockey players. Thus, in preferred embodiments the base of the first supporting structure is configured to be slide-resistant when the first supporting structure is resting on an ice surface. This can be achieved in multiple ways. For example, a useful degree of slide resistance may be obtained by selecting the material used to form the first supporting structure (or at least the bottom portion of the first supporting structure that contacts the ice surface) to be a material that resists sliding. Such materials include synthetic rubber, nitrite rubber and natural rubber, for example. Other approaches including configuring the bottom of the first supporting structure to be rough with jagged portions, or having spikes extending from the bottom of the first supporting structure. Such spikes may be integrally formed with, or hingedly attached to, the first supporting structure and may be fixed or retractable. The lower end of the second supporting structure is also preferably configured to be slide-resistant when the second supporting structure is resting on an ice surface.

As shown in FIG. 3, the nose cone 101 has a circular lower opening that may be sized and shaped to receive and frictionally engage a hockey puck. When a puck is lying on the ice, for example, the nose cone 101 can then be placed over the puck and pushed down on the puck to create a frictional attachment. The weight of the puck provides a degree of slide resistance and stability against lateral forces.

Likewise, the base cone can be placed over two pucks, the weight of which provide a degree of slide resistance and stability against lateral forces.

It should be understood that the above-described embodiments of the present invention, particularly, any "preferred" embodiments, are only examples of implementations, merely set forth for a clear understanding of the principles of the invention. Many variations and modifications may be made to the above-described embodiment(s) of the invention as will be evident to those skilled in the art. That is, persons skilled in the art will appreciate and understand that such modifications and variations are, or will be, possible to utilize and carry out the teachings of the invention described herein.

Where, in this document, a list of one or more items is prefaced by the expression "such as" or "including", is followed by the abbreviation "etc.", or is prefaced or followed by the expression "for example", or "e.g.", this is done to expressly convey and emphasize that the list is not exhaustive, irrespective of the length of the list. The absence of such an expression, or another similar expression, is in no way intended to imply that a list is exhaustive. Unless otherwise expressly stated or clearly implied, such lists shall be read to include all comparable or equivalent variations of the listed item(s), and alternatives to the item(s), in the list that a skilled person would understand would be suitable for the purpose that the one or more items are listed.

The words "comprises" and "comprising", when used in this specification and the claims, are used to specify the presence of stated features, elements, integers, steps or components, and do not preclude, nor imply the necessity for, the presence or addition of one or more other features, elements, integers, steps, components or groups thereof.

The scope of the claims that follow is not limited by the embodiments set forth in the description. The claims should be given the broadest purposive construction consistent with the description and figures as a whole.

What is claimed is:

1. A training apparatus for training athletes comprising a bar having first and second ends, a first supporting structure, and a second supporting structure, the first supporting structure comprising a base configured to rest on a surface and having a portion extending upwardly from the base to an upper end comprising walls defining an interior space, the walls having a first bar connector spaced apart from the base at a height above the base, the first bar connector being configured to connect to and support the first end of the bar, the walls having support elements spaced apart from the base, the second supporting structure having walls defining an interior space and having a lower end, the walls being configured to permit the lower end of the walls to engage the support elements so that the second supporting structure is supported by the first supporting structure above the supporting elements, thereby creating a combined structure, the second supporting structure having a first bar connector at a height above the lower end of the walls of the second supporting structure substantially the same as the height of the first bar connector above the base of the first supporting structure, the first bar connector of the second supporting structure being configured to connect to and support the second end of the bar, wherein the support elements comprise a ledge extending around the walls of the first supporting structure, the ledge being spaced apart from the upper end of the walls, and wherein the ledge extends laterally from the walls of the first supporting structure towards the interior space of the first supporting structure, and the ledge and the second supporting structure are configured so that when the lower end of the second supporting structure engages the ledge so that the second supporting structure is supported by the ledge, the outer surface of the second supporting structure and the outer surface of the walls of the first supporting structure provide a smooth and continuous outer wall of the combined structure, and wherein the walls of the first supporting structure are tapered inwardly from the base towards the upper end, and the walls of the second supporting structure are tapered inwardly from the lower end of the walls upwards to a top of the second supporting structure so that the combined structure has a width that continuously narrows from the base of the first supporting structure to the top of the second supporting structure.

2. The training apparatus of claim 1, wherein, when the lower end of the walls of the second supporting structure is engaged with the supporting elements so that the second supporting structure is supported by the first supporting structure above the supporting elements, an upper portion of the walls of the first supporting structure extends into the interior space of the second supporting structure.

3. The training apparatus of claim 1, wherein the walls of the first supporting structure further comprise risers extending outwardly, the risers being spaced apart from the ledge.

4. The training apparatus of claim 1, wherein the first and second supporting structures comprise locking mechanisms to releasably lock the structures together when the lower end of the walls of the second supporting structure is engaged with the supporting elements of the first supporting structure.

5. The training apparatus of claim 2, wherein the first and second supporting structures comprise locking mechanisms to releasably lock the structures together when the lower end of the walls of the second supporting structure is engaged with the supporting elements of the first supporting structure, and wherein the locking mechanisms comprise the configuration of the structures so that the outer surface of the upper portion of the walls of the first supporting structure that extends into the interior space of the second supporting structure frictionally engages the inner surface of a portion of the walls of the second supporting structure.

6. The training apparatus of claim 1, wherein different portions of the ledge are at differing heights above the base and the lower end of the walls of the second supporting structure is configured to engage with all the portions of the ledge.

7. A first training apparatus according to claim 1, wherein the first supporting structure has a lower opening and when the lower end of the walls of the second supporting structure is engaged with the supporting elements so that the second supporting structure is supported by the first supporting structure above the supporting elements, the first training apparatus is nestable with a second training apparatus, the second training apparatus comprising a bar having first and second ends, a first supporting structure, and a second supporting structure, the first supporting structure comprising a base configured to rest on a surface and having a portion extending upwardly from the base to an upper end comprising walls defining an interior space, the walls having a first bar connector spaced apart from the base at a height above the base, the first bar connector being configured to connect to and support the first end of the bar, the walls having support elements spaced apart from the base, the second supporting structure having walls defining an interior space and having a lower end, the walls being configured to permit the lower end of the walls to engage the support elements so that the second supporting structure is supported by the first supporting structure above the supporting elements, the second supporting structure having a first bar connector at a height above the lower end of the walls of the second supporting structure substantially the same as the height of the first bar connector above the base of the first supporting structure, the first bar connector of the second supporting structure being configured to connect to and support the second end of the bar, wherein the walls of the first supporting structure are tapered inwardly from the base towards the upper end, and the walls of the second supporting structure are tapered inwardly from the lower end upwards, wherein the first training apparatus and the second training apparatus are configured so that when the second training apparatus is placed on the first training apparatus, then the lower end of the walls of the second supporting structure of the second training apparatus is engaged with the supporting elements of the second training apparatus so that the second supporting structure of the second training apparatus is supported by the first supporting structure of the second training apparatus above the supporting elements, by inserting the second supporting structure of the first training apparatus into the lower opening of the first supporting structure of the second training apparatus and pushing the second training apparatus downward.

8. The training apparatus of claim 1, wherein the bar connectors are configured and located so that when the base of the first supporting structure and the lower end of the walls of the second supporting structure are resting on the same surface, the bar and the first and second supporting structures are placeable so that the first end of the bar is supported by the first bar connector in the first supporting structure and the second end of the bar is supported by the first bar connector of the second supporting structure at the same time so that the bar is substantially parallel to the surface and the bar is spaced apart from the surface by more than one inch.

9. The training apparatus of claim 1, wherein the walls of the first and second supporting structures are frusto-conical, and wherein the first supporting structure has no top portion covering the interior space to facilitate stacking of multiple apparatus.

10. The training apparatus of claim 1, wherein the walls of the first supporting structure have a second bar connector, the second bar connector being configured to connect to and support the first end of the bar.

11. The training apparatus of claim 1, wherein the second supporting structure has a second bar connector, wherein the bar is placeable so that the first end of the bar connects to the first bar connector of the second supporting structure while a second bar connects to the second bar connector of the second supporting structure.

12. The training apparatus of claim 1, wherein the base of the first supporting structure is configured to resist sliding when the first supporting structure rests on ice.

13. The training apparatus of claim 12, wherein the base of the first supporting structure comprises a material that resists sliding on an ice surface.

14. The training apparatus of claim 12, wherein the lower end of the walls of the second supporting structure are configured to resist sliding when the second supporting structured rests on an ice surface.

15. The training apparatus of claim 1, wherein the walls of the first and second supporting structures each define a hollow pyramidal structure.

16. A training apparatus for training athletes comprising a hollow base cone and a hollow nose cone, the nose cone and base cone being configured to allow the nose cone to releasably lock atop the base cone to form a single combined cone that is nestable with other combined cones for storage, the base cone and nose cone being configured so that the combined cone has a smooth and continuous outer wall, the base cone and nose cone each having a mechanism for releasably connecting to opposite ends of an expandable, elongated cross member such that the cross member is supported above a flat surface upon which the base cone and nose cone rest, the cross member being supportable by the cones so that it is substantially parallel to the flat surface.

17. A training apparatus for training athletes comprising a bar having first and second ends, a first supporting structure, and a second supporting structure, the first supporting structure comprising a base configured to rest on a surface and having a portion extending upwardly from the base to an upper end comprising walls defining an interior space, the walls having a first bar connector spaced apart from the base at a height above the base, the first bar connector being configured to connect to and support the first end of the bar, the walls having a ledge spaced apart from the base and extending laterally from the outer surface of the walls of the first supporting structure towards the interior space of the first supporting structure, the ledge extending no further laterally from the interior space of the first supporting structure than the outer surface of the of the walls of the first supporting structure, the second supporting structure having walls defining an interior space and having a lower end, the walls being configured to permit the lower end of the walls to engage the ledge so that the second supporting structure is supported by the first supporting structure in a position above the ledge, the ledge and the second supporting structure configured so that a combined structure is created when the second supporting structure is supported by the ledge, the outer surface of said combined structure creating a frusto-conical shape wherein the walls of said first and second supporting structures are aligned and flush with each other, the second supporting structure having a bar connector at a height above the lower end of the walls of the second supporting structure substantially the same as the height of the first bar connector above the base of the first supporting structure, the bar connector of the second supporting structure being configured to connect to and support the second end of the bar, and wherein the walls of the first supporting structure are tapered inwardly from the base towards the upper end, and the walls of the second supporting structure are tapered inwardly from the lower end of the walls upwards to a top of the second supporting structure so that the combined structure has a width that continuously narrows from the base of the first supporting structure to the top of the second supporting structure.

18. The training apparatus of claim 1, wherein no portions of the second supporting structure are below the lower end of the walls of the second supporting structure.

19. The training apparatus of claim 1, wherein the first and second supporting structures have approximately equal heights.

20. The training apparatus of claim 1, wherein the supporting structures are not the same shape.

* * * * *